US008020569B2

(12) United States Patent
Leonardich et al.

(10) Patent No.: US 8,020,569 B2
(45) Date of Patent: Sep. 20, 2011

(54) PORTABLE CONCRETE WASHOUT FACILITY

(75) Inventors: Ernest Kim Leonardich, Santa Cruz, CA (US); Norman P. Gruczelak, Ben Lomond, CA (US)

(73) Assignee: Onsite Washout Corp., Ben Lomond, CA (US)

( * ) Notice: Subject to any disclaimer, the term of this patent is extended or adjusted under 35 U.S.C. 154(b) by 560 days.

(21) Appl. No.: 12/191,871

(22) Filed: Aug. 14, 2008

(65) Prior Publication Data

US 2009/0044832 A1 Feb. 19, 2009

Related U.S. Application Data

(60) Provisional application No. 61/066,273, filed on Feb. 19, 2008, provisional application No. 60/999,406, filed on Oct. 17, 2007, provisional application No. 60/965,101, filed on Aug. 18, 2007.

(51) Int. Cl.
*B08B 3/02* (2006.01)

(52) U.S. Cl. ..... 134/104.4; 134/104.2; 134/108; 134/109; 134/111; 134/178; 134/198

(58) Field of Classification Search ..... 134/103.1, 134/103.2, 104.2, 104.4, 108, 109, 111, 173–178, 134/198; 210/194, 196, 251
See application file for complete search history.

(56) References Cited

U.S. PATENT DOCUMENTS

| | | | | |
|---|---|---|---|---|
| 3,774,633 | A | 11/1973 | Decker | |
| 5,741,065 | A | 4/1998 | Bell | |
| 6,155,277 | A * | 12/2000 | Barry | 134/104.4 |
| 6,354,439 | B1 | 3/2002 | Arbore | |
| 6,866,047 | B1 | 3/2005 | Marvin | |
| 6,966,687 | B1 | 11/2005 | Elefsrud | |
| 7,117,995 | B2 | 10/2006 | Connard, III | |
| 7,147,360 | B2 | 12/2006 | Elefsrud | |
| 2004/0016824 | A1 * | 1/2004 | Kawamoto | 239/302 |
| 2004/0105741 | A1 | 6/2004 | Inglese | |
| 2004/0124190 | A1 | 7/2004 | Beyer | |
| 2006/0000490 | A1 | 1/2006 | Barragan | |
| 2006/0059653 | A1 | 3/2006 | Mickelson | |
| 2006/0222270 | A1 | 10/2006 | Modena | |
| 2007/0002677 | A1 * | 1/2007 | DeCollibus et al. | 366/68 |

OTHER PUBLICATIONS

International Search Report and Written Opinion for PCT/US07/10610 mailed Sep. 3, 2008 in 19 pages.

* cited by examiner

*Primary Examiner* — Michael Barr
*Assistant Examiner* — Saeed T Chaudhry
(74) *Attorney, Agent, or Firm* — Knobbe, Martens, Olson & Bear LLP

(57) ABSTRACT

Apparatuses and methods can reduce washout water use and facilitate removal of waste. A transport vehicle can include a water holding tank, a washout tub, and a means for conveying water. Water can be conveyed from the water holding tank to clean concrete from utensils, chutes, pumps, and other implements through a hose. The water can then be separated from the concrete and conveyed back into the water holding tank using a hose and a strainer.

13 Claims, 6 Drawing Sheets

PORTABLE CONCRETE WASHOUT FACILITY

CROSS-REFERENCE TO RELATED APPLICATIONS

This application claims the benefit of U.S. Provisional Application Nos. 61/066,273; 60/999,406; and 60/965,101 filed Feb. 19, 2008, Oct. 17, 2007, and Aug. 18, 2007 respectively, the entire contents of which is expressly incorporated herein by reference.

BACKGROUND OF THE INVENTION

1. Field of the Invention

The invention generally relates to concrete cleaning facilities and methods for cleaning concrete-related machines and tools.

2. Description of the Related Art

Typically large construction sites provide for washout of excess concrete from concrete pumps, ready mix trucks, and other tools and implements by providing either a large pond lined with plastic or a large metal tub. The pond or tub collects the washout water and excess concrete so as not to contaminate the area. At the end of the job or when the facility is full the contractor faces a difficult and expensive job of removing the waste water and concrete.

For smaller jobs the ready mix trucks still need a place to wash out their chutes and other implements need to be cleaned, and trailer concrete pumps need to be washed out. Federal and many local governments are passing strict rules and laws to protect the environment from pollution on construction sites.

SUMMARY OF THE INVENTION

The invention provides a low cost portable concrete washout and cleanup facility and a washout method for use on, for example, construction sites. Contaminated waste water can be recycled for further use in the washout process by a portable concrete washout facility. The facility can include a transport vehicle with a tub configured to receive concrete washout from a concrete truck chute. The tub can connect to the transport vehicle via a pivot allowing the tub to move from a receiving position to a dumping position. The tub's movement can be restrained by two cooperating latch portions configured to further attach the tub to the transport vehicle. A filtration system can also be mounted to the transport vehicle, and can be configured to remove water from the tub but not remove concrete from the tub.

In another embodiment a portable concrete washout facility with a transport vehicle can include a water holding tank mounted on the transport vehicle. The water holding tank can have a water inlet and a water outlet connected to a pump. The pump can be in optional fluid communication with the water inlet via a first selector valve and the water outlet via a second selector valve. Additionally, a first hose can be connected to the first valve such that either the first hose or the water inlet is in fluid communication with the pump. The other end of the first hose can be connected to a water-concrete separator. Similarly, a second hose can be connected to the second valve such that either the second hose or the water outlet is in fluid communication with the pump. The other end of the second hose can be configured to spray water at velocities sufficient to remove concrete.

In another embodiment, a portable washout facility can reduce washout water use and facilitate removal of waste. The facility can include a transport vehicle and a water holding tank mounted to the transport vehicle. The tank can be in fluid communication with a means for conveying water, which is connected to a first hose and a second hose. The first hose can have a water-solid separator attached at an opposite end. The second hose can coordinate with a washout tub mounted on the transport vehicle, such that the tub can receive the water-solid separator and receive water from the second hose. Further, the water conveying means can be configured to actively pump water across the first hose into the water holding tank and across the second hose out of the water holding tank.

In an additional embodiment, a method of cleaning concrete at a construction site is disclosed. A portable concrete washout facility comprising a washout tub and a water holding tank can be provided. A concrete chute, concrete utensils, or other concrete-contaminated objects can be positioned above the washout tub. The concrete on the chute, utensils, or other objects can be removed with water such that the water and concrete enter the washout tub. The water in the tub can be strained into the water holding tank and the concrete can be left in the tub to harden. Once hard, the tub can be tilted such that such that the hardened concrete is removed from the tub.

BRIEF DESCRIPTION OF THE DRAWINGS

The foregoing and other features, aspects and advantages of the present invention are described in detail below with reference to the drawings of various embodiments, which are intended to illustrate and not to limit the invention. The drawings comprise the following figures in which.

DETAILED DESCRIPTION OF THE PREFERRED EMBODIMENT

Figure 1:
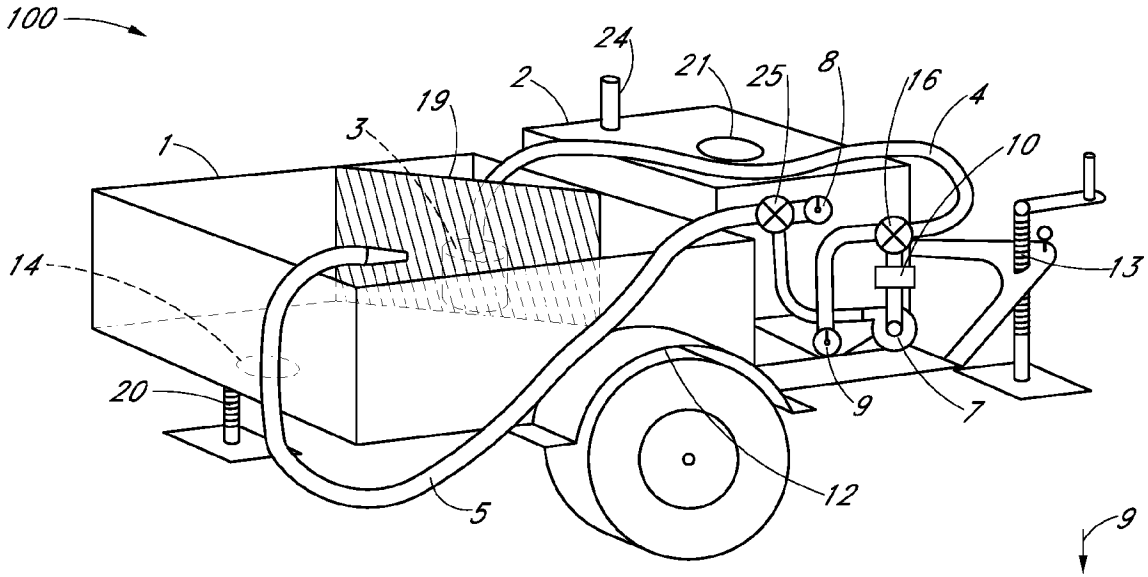
FIG. 1 illustrates an embodiment of a portable concrete washout facility.

The disclosure herein provides apparatuses and methods for concrete washout. One embodiment of such an apparatus is depicted in FIG. 1. A portable concrete washout facility 100 is depicted, in this embodiment, as a portable trailer 12 configured to attach to a car, truck, or other transporters known in the art. Accordingly, the washout facility 100 can be easily transported between different job sites. The trailer 12 can comprise jacks 13, 20, that can facilitate cleanout of the washout facility 100 (further described below), and to stabilize the tank during activity.

As depicted, a washout water holding tank 2 mounts on the washout facility 100 (fluids other than water may be used where suitable). The holding tank 2 can be welded and/or molded from metals and/or plastics. As shown, in FIG. 1, the holding tank 2 comprises a box shape, but it can comprise other shapes including a round, tubular shape as depicted in FIGS. 5, 6, 8, and 9. The holding tank 2 can comprise a vent 24 at the top of the tank capable of stabilizing pressure within the tank. Also, a large opening 21 can be provided near or at the top of the holding tank 2 to provide for easy cleaning (as further discussed below). The opening 21 can comprise a removable cover to prevent spillage during transport. Similarly, the holding tank 2 can comprise a drain 6 with a corresponding cap 22 (shown in FIG. 5). The drain 6 can be located at a lowest portion of the holding tank 2 created by a slight taper along the bottom of the tank. The slight taper can cause sediments in the tank 2 to collect near the drain, facilitating removal.

The holding tank 2 can further comprise an inlet 8 and an outlet 9, through which water can be provided or removed. The inlet 8 can be located near the top of the holding tank 2 and the outlet 9 can be located near the bottom. When sediment is present in the holding tank 2 the outlet 9 can be positioned above a maximum expected sediment level. Both the inlet 8 and outlet 9 can connect to one or more water conveyor systems 27 (examples depicted in FIGS. 2 and 3).

Figure 2:
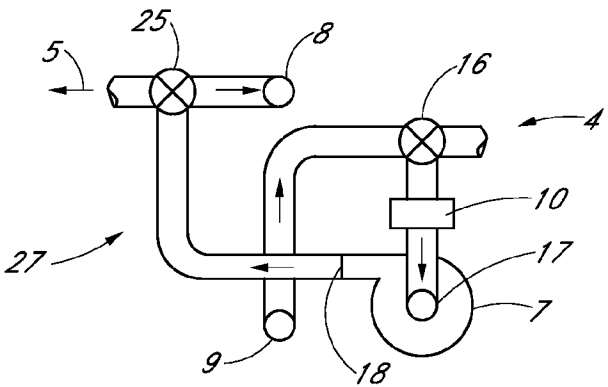
FIG. 2 illustrates an embodiment of a water conveyor system from the facility of FIG. 1.

As depicted in FIG. 2, the water conveyor system 27 is best described as a single system, as opposed to the two-part system 27' depicted in FIG. 3 (discussed below). As shown more clearly in FIG. 2, the water conveyor system 27 comprises a single pump 7 optionally fluidly coupled to the water holding tank 2 via an inlet selector valve 16 and/or an outlet selector valve 25.

The pump 7 can generally be a water pump of a form known in the art. In preferred embodiments the pump can be self-priming. The pump 7 can further be resilient against debris such as the sediment in waste washout water. The pump 7 comprises an inlet 17 and an outlet 18.

As depicted the pump inlet 17 receives water from either a strainer hose 4 or the holding tank outlet 9, depending on the state of the inlet valve 16. Similarly, as depicted, the pump outlet 18 pumps water either to a washout hose 5 or the holding tank inlet 8. As discussed further below, this configuration advantageously allows water to be pumped from the holding tank 2 to the washout hose 5 or alternatively from the strainer hose 4 to the holding tank. Further, if desired the conveyor system 27 can pump water directly from the strainer hose 4 to the washout hose 5. Finally, the conveyor system 27 can pump water from the holding tank outlet 9 to the holding tank inlet 8, circulating the fluid in the holding tank 2. The conveyor system 27 can further comprise a filter 10 prior to the pump 7 to protect the pump from contaminants that may damage or hinder the operability of the pump, valves, or any other element of the washout facility 100.

Figure 3:
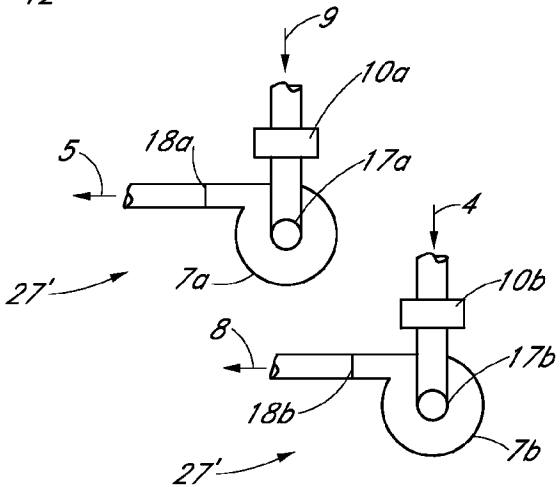
FIG. 3 illustrates another embodiment of a water conveyor system.

In another embodiment, the water conveyor system 27' can comprise two pumps 8*a* and 8*b*, as depicted in FIG. 3. In this embodiment no selector valves are used, as each pump is devoted to a separate water path (from the outlet 9 to the washout hose 5 and from the strainer hose 4 to the inlet 8); although other valves may still be used, for example, to restrain fluid flow when the facility 100 is not in use. Further, in this configuration water can be pumped along each path simultaneously, potentially creating a continuous flow. Although further description herein may describe the apparatus as having only one pump, it will be clear from the disclosure herein that similar applications can be provided in accordance with the invention with two or more pumps.

As depicted, the strainer hose 4 and the washout hose 5 can be configured to communicate with a washout tub 1 mounted to the washout facility 100. Like the holding tank 2, the washout tub 1 can be welded and/or molded from metal and/or plastic. Further, the surface of the washout tub 1 can comprise a material that releases easily from concrete. As depicted, the washout tub 1 comprises an open area large enough to accommodate the washout of concrete truck chutes and other implements and tools. In a preferred embodiment, the walls of the tub 1 can comprise a slight taper expanding toward the opening, facilitating removal of hardened concrete. The tub 1 can further comprise a cleanout drain 14 made from plastic or metal pipe with an easy opening waterproof cap (not shown). Further, as depicted the washout tub 1 can comprise a removable screen 19 configured to separate a portion of the tub for positioning of a strainer 3 (one embodiment of such a strainer being described in U.S. application Ser. No. 11/743,012 which is incorporated by reference) attached to the strainer hose 4.

The strainer 3 can be mounted to the end of the strainer hose 4 and can comprise a strainer screen with suitable openings to keep concrete aggregate from entering the pump inlet 17. In other embodiments, holes punched in metal or plastic can replace or supplement the screen material.

Figure 5:
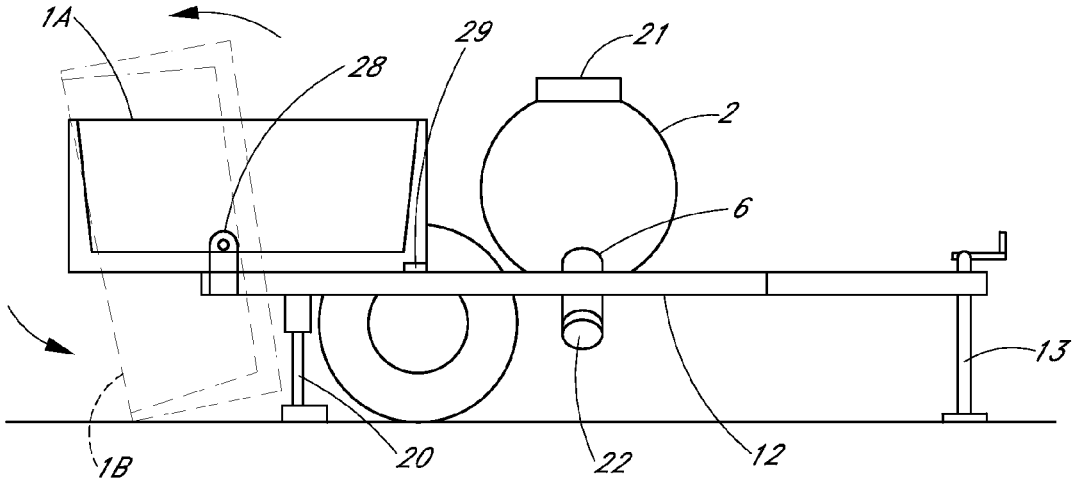
FIG. 5 illustrates an embodiment use of a portable concrete washout facility to tilt a washout tub.

FIG. 5 depicts further modifications that can be made to a washout facility 100. As depicted, the tub 1 can be mounted on a pivot 28, which can comprise bearings, bushings, axles, or other rotatable load-bearing structures known in the art. The pivot 28 can be located near an edge of the trailer 12, allowing the tub 1 to rotate passed vertical such that its contents may be dumped. Alternatively, the pivot 28 can be located substantially within the trailer 12 and the trailer 12 may comprise an opening such that the tub 1 can rotate as needed and dump its contents through said opening.

By rotating past vertical the tub 1 can dump its contents without use of a waterproof door, gate, or other opening device (i.e. with substantially static, non-moving walls). Similarly, where the taper of the tub 1 at a dumping end is sufficiently shallow, the tub 1 need not rotate past vertical to remove its contents, although greater rotation can still further facilitate removal. It will be clear from the disclosure herein that the required rotation for dumping without an opening device will depend on the taper of the tub 1 at a dumping end.

Notably, the force needed to rotate the tub 1 can depend on the location of the pivot 28 relative to the tub. In embodiments where the tub 1 is configured to pivot under human force, the pivot 28 can be positioned near the center of the tub 1, or possibly further towards a side of the tub nearer the trailer 12 such that a majority of the tub 1 is cantilevered. In such embodiments a latch 29 can be provided to restrain the tub 1 from tipping. Alternatively, the pivot 28 may be positioned oppositely, such that the majority of the tub 1 is directly supported by the trailer 12. In such embodiments the tub might be sufficiently stable to not need a latch, although one can still be provided for increased safety. Notably, in such embodiments the tub 1 may be more difficult to rotate, and thus a motorized, hydraulic, or mechanically-advantaged tilting mechanism can be provided such as a jack, lever, or other implement configured to tilt the tub or the trailer 12. In a preferred embodiment, the tub's center of gravity is positioned above the trailer 12 and only slightly away from the edge of the trailer, such that the tub 1 does not tip without an applied force, but does tip with a relatively slight applied force.

In other preferred embodiments the tub 1 can be elongated, increasing its volume so it can receive more washout. However, elongation of the tub 1 can reduce its freedom of rotation, because an elongated tub 1 may come in contact with the ground prior to rotating past vertical. Accordingly, for elongated tubs 1, the tub can be positioned such that its geometric center is above the trailer 12 and further from the edge of the trailer. When the center of gravity is similarly far from the edge of the trailer 12 tilting mechanisms can be used to facilitate tilting of the tub 1. Alternatively, in some embodiments the tub 1 can include counterweights, such that the gravitational center of the tub 1 is closer to the edge of the trailer 12 than the tub's geometric center. In such embodiments an elongated tub can rotate freely and easily.

Figure 8:
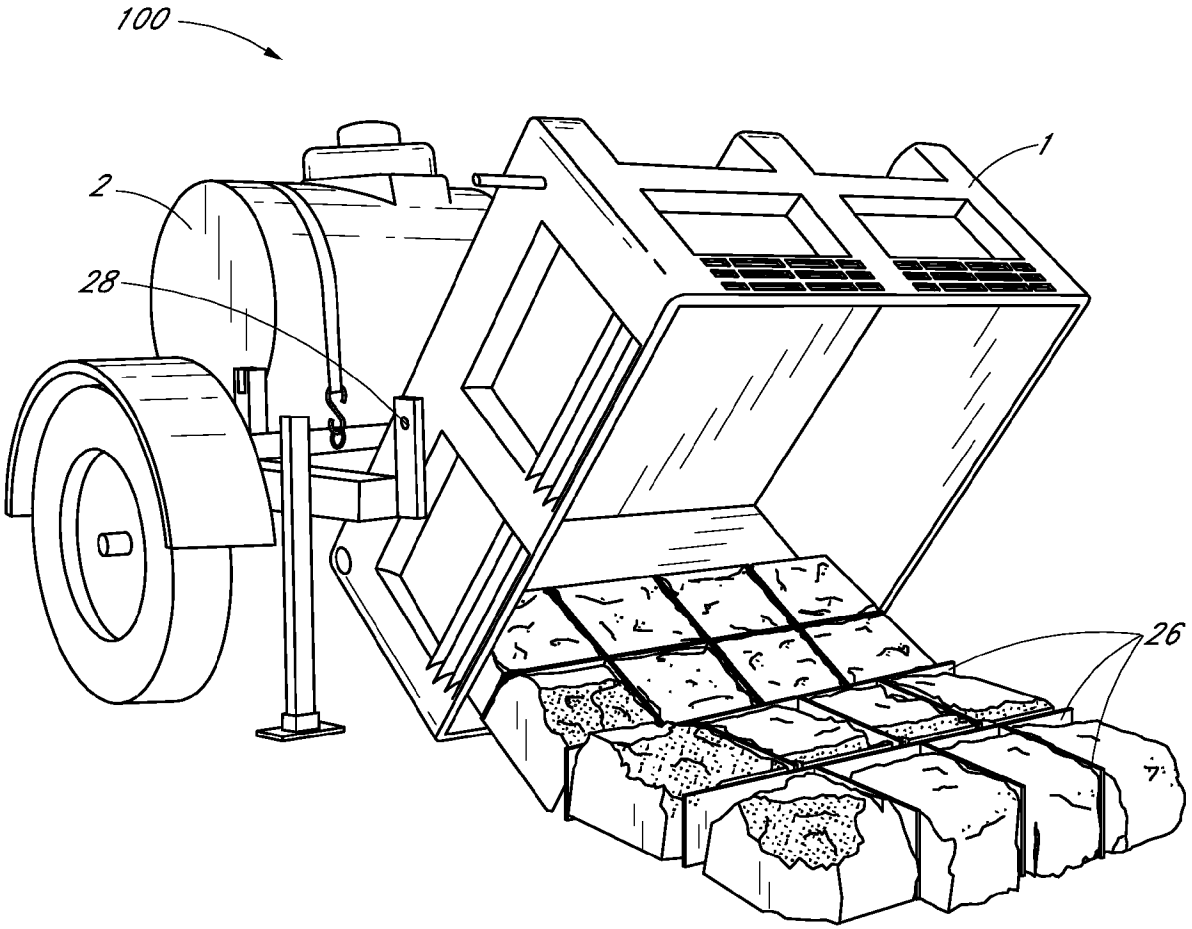
FIG. 8 illustrates an embodiment use of a portable concrete washout facility to dump waste concrete from a washout tub.

In some embodiments, the tub 1 can further comprise partitioners 26 (as further described in U.S. application Ser. No. 11/743,012 which is incorporated by reference). The partitioners 26 can separate the tub 1 into sections. When concrete sets within the tub 1, the partitioners 26 allow the concrete to easily break into easily manageable pieces, as depicted in FIG. 8. In other embodiments the partitioners 26 can be given a specific geometry to form commercially desirable shapes such as cinderblocks, stepping stones, and the like. The partitioners 26 can comprise a disposable material such as fiberboard, plastic, or the like.

Figure 9:
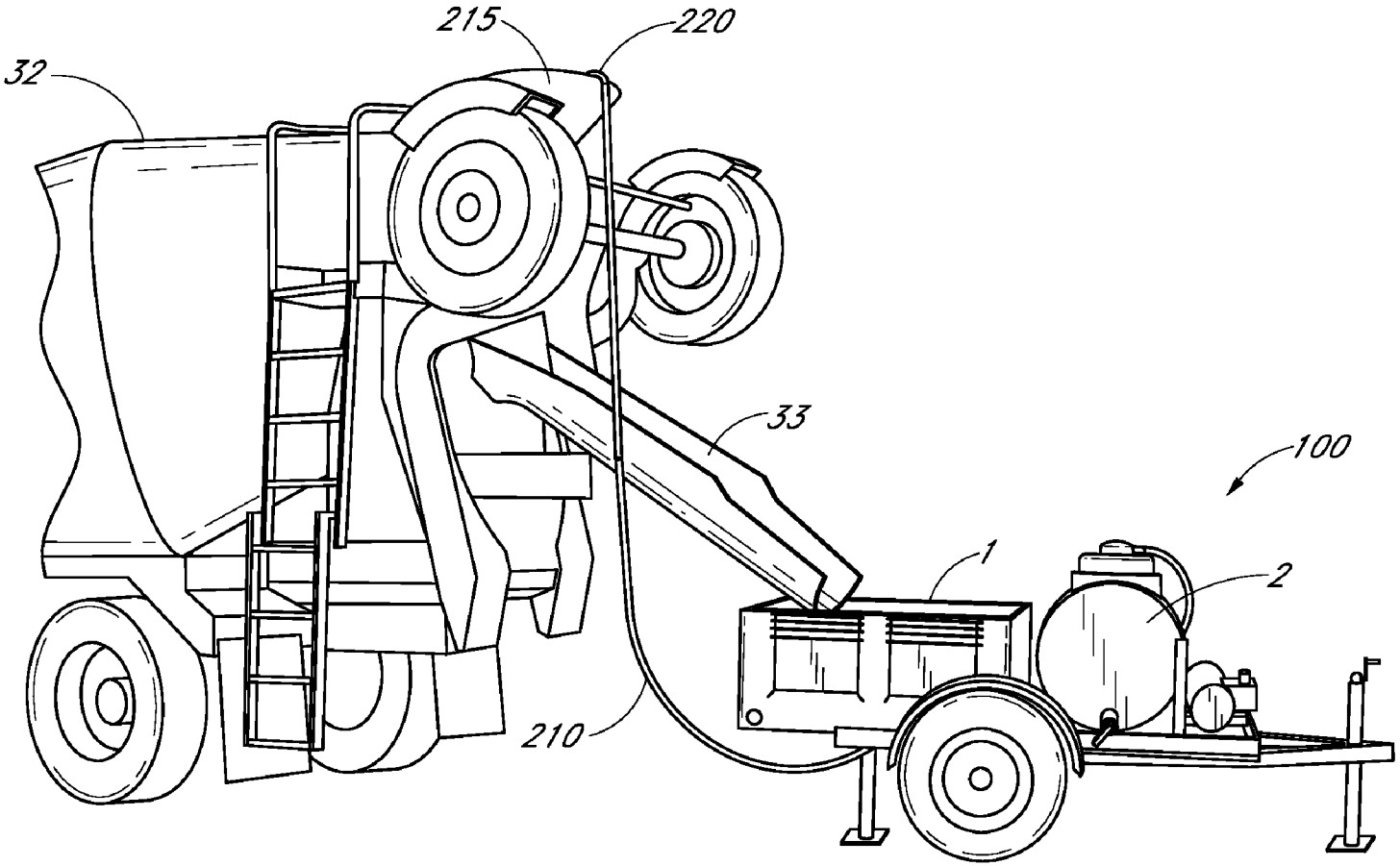
FIG. 9 illustrates an embodiment use of a portable concrete washout facility to return waste water to a mixer truck.

As an additional feature, the washout facility 100 can comprise a hose 210 with a hooked end 220, as depicted in FIG. 9. A pole can be used to put the hooked end 220 of the hose 210 in a truck inlet hopper 215, as discussed further below. Thus, in preferred embodiments the pole can comprise a length slightly less than the expected height of the hopper 215 or some other intended receptacle, or can comprise an adjustable height. In embodiments without a pole, the hose 210 can be simply carried up to the hopper 215 or the hose 210 can comprise an integral rigid portion or tube acting in a manner similar to the pole.

For larger jobs, it may be desired to have additional capacity in the washout tub 1 and/or the water holding tank 2. Accordingly, the washout facility 100 can comprise an additional trailer, tub, and or water tank depending on needs. For example, a second trailer may comprise an additional tank and pump so as to provide additional water and/or faster water removal. The second trailer could then strain water from the washout tub 1 of the first washout facility 100 into the separate tank so the first washout facility 100 can then be transported without risk of spillage and/or contamination. It will be clear from the disclosure herein, that in some embodiments the washout tub 1 and the water holding tank 2 can also be provided on separate trailers, allowing each to have a larger capacity.

Operation

The above-described washout facility 100 can be used to clean a number of substances from various tools and implements. As described herein the facility is used to clean concrete, but it will be clear to those of skill in the art that the same principles can be applied to other situations.

1. Washout of Ready Mix Truck Chutes and Equipment Using Holding Tank Water

Figure 7:
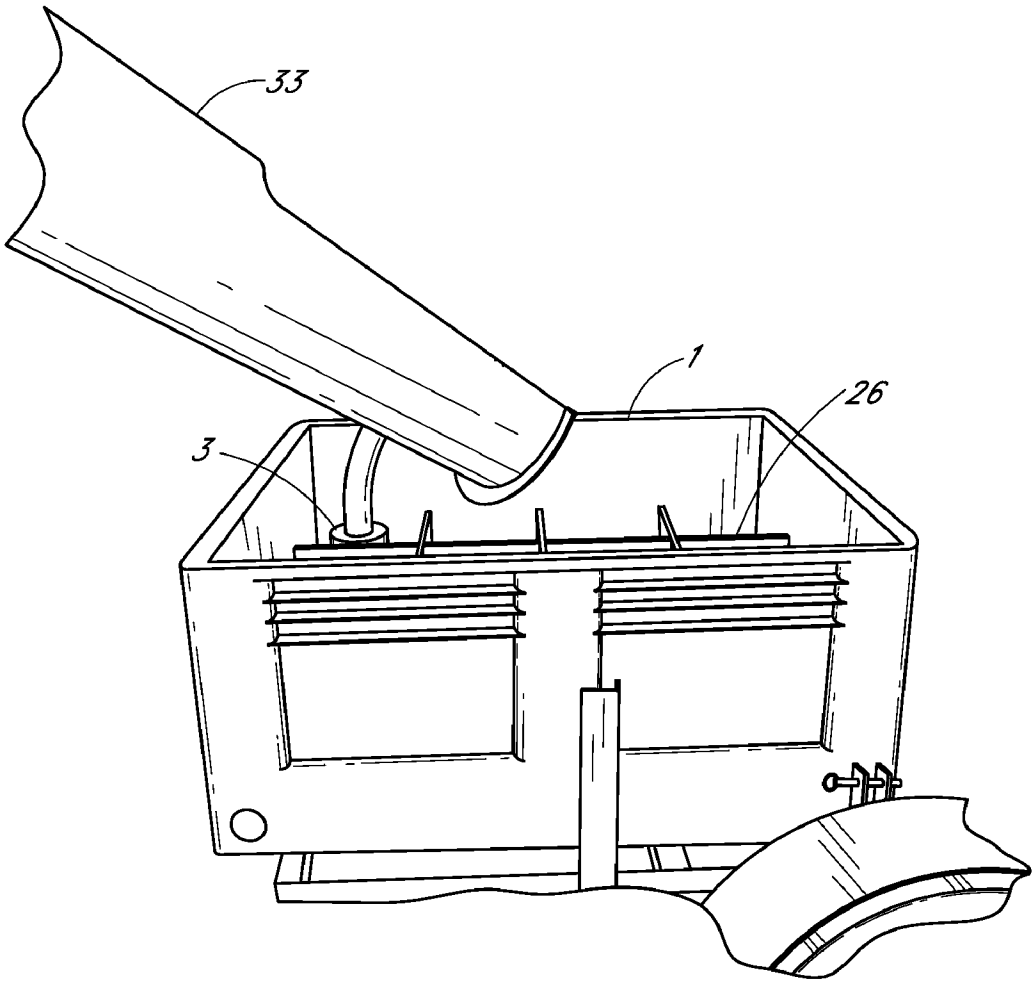
FIG. 7 illustrates an embodiment use of a portable concrete washout facility to washout a concrete chute.

In one aspect of the invention, the washout facility 100 can be used to clean concrete mix truck chutes and/or other concrete tools and equipment. The washout facility 100 can be positioned at a location suitable for concrete truck chute and trailer pump washout and the cleanup of tools and utensils used on the job. The washout facility 100 can arrive at a job site with a full water holding tank 2 (although where other water sources are available the water holding tank can be empty or only partially full). Concrete trucks can finish their pour and then back up to the back or side of the washout tub 1 (as shown in FIG. 7). The chute 33 can then be washed with high pressure water carried by the concrete truck, or with water from the washout hose 5 pumped from the water holding tank 2 by the water pump 7, or from local water supplies such as tap water. The washout tub 1 collects the waste water and waste concrete, and the surrounding area can be left clean of any contamination. In a like manner, tools, forms, and molds used on the job can be brought to the washout tub 1 to be cleaned. When water from the concrete truck is used, the water can be pumped back into the truck after cleaning, as discussed further below.

2. Washout of Concrete Pumps

Figure 6:
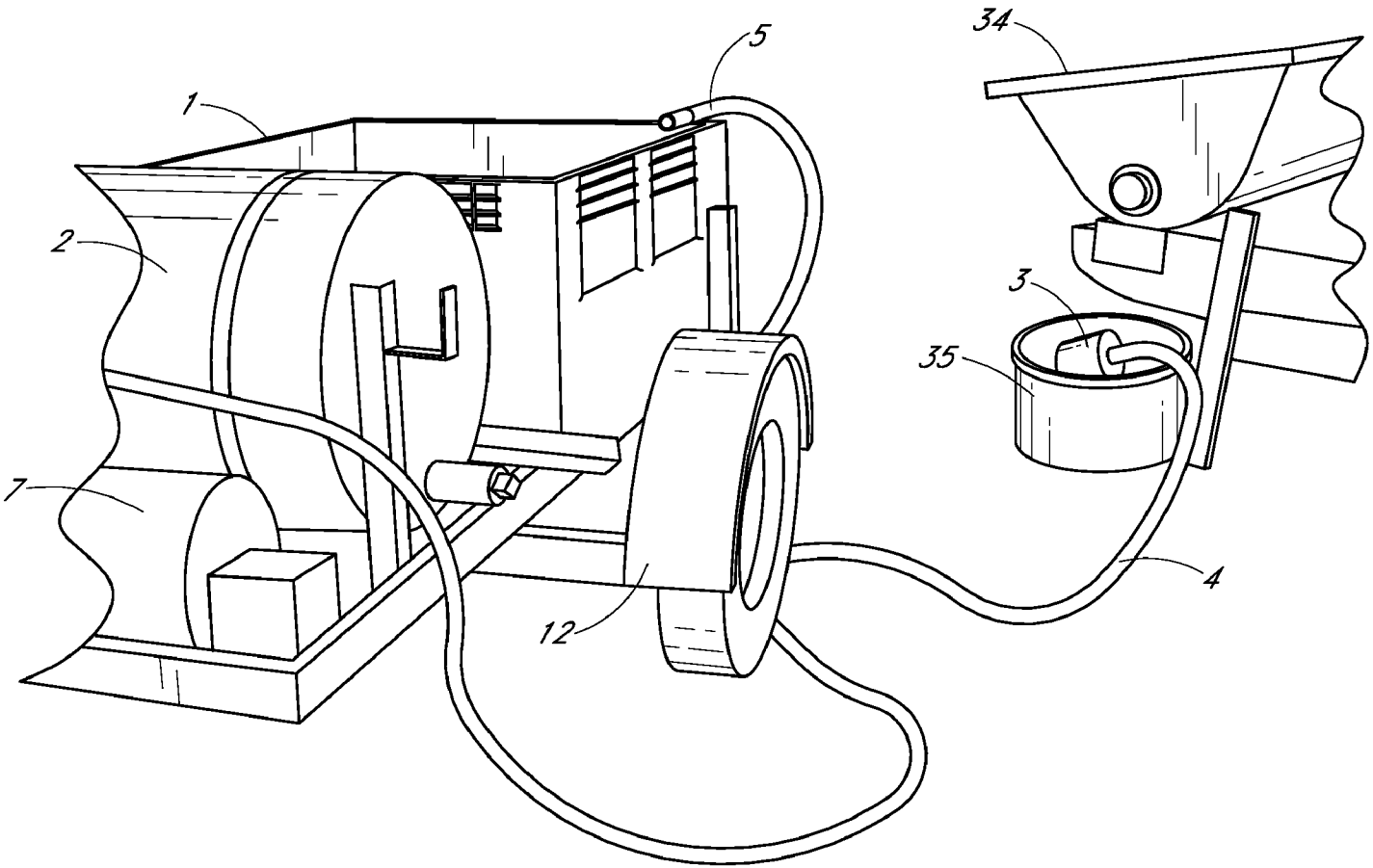
FIG. 6 illustrates an embodiment use of a portable concrete washout facility to washout a concrete pump.

Further, the washout facility 100 can be used to washout a concrete pump, as depicted in FIG. 6 (shown removing water from the washout). First, the washout facility 100 can clean the concrete pump. The water pump inlet 17 can be connected to the outlet 9 of the water holding tank 2 through the inlet valve 16, and the water pump outlet 18 can be connected to the washout hose 5 through the outlet valve 25. The cleanout outlet of concrete pump hopper 34 can be positioned over an auxiliary waste concrete tub 35 which can, if desired, contain partitioners 26. The concrete pump and hopper 34 can be washed out into the auxiliary tub 35 using the washout hose 5.

The washout facility 100 can then remove water from the auxiliary tub 35. The inlet valve 16 can connect the pump inlet 17 to the strainer hose 4 and the outlet valve 25 can remain unchanged so that pump outlet 18 remains connected to washout hose 5 which is now positioned to feed into the washout tub 1, as shown in FIG. 6. The strainer can be partially submerged into the waste concrete in the auxiliary tub 35, and is used to remove washout water from the tub. In this manner, the auxiliary tub 35 can collect waste concrete for later easy disposal with washout water separated and fed into the facility washout tub 1 to be recycled. When the concrete in the auxiliary tub 35 hardens it can be tipped over to remove the waste concrete. If partitioners 26 (further described below) are used the waste concrete can break into small easily handled pieces for disposal at the job site.

Because the water now in the facility washout tub 1 may still hold various sediments, it can be allowed to settle before pumping and filtering the water back into the water holding tank 2. Alternatively, if desired (e.g. due to time constraints) the washout water can be pumped directly into the water holding tank 2 without giving it time to settle if a superior strainer 3 is used, if sediment in the water holding tank 2 and through the water pump 7 can be more easily tolerated, or for some other reason.

Similarly, the washout may be allowed to settle first in an auxiliary tub 35 and then water can be pumped directly into the water holding tank 2, in which case the washout facility 100 can in some embodiments comprise a water holding tank 2 and no washout tub 1. In this instance, the auxiliary tub 35 can be specially configured for removal of set concrete, as discussed above regarding the facility washout tub 1, and additionally discussed in U.S. application Ser. No. 11/743,012 which is incorporated by reference.

3. Return of Ready Mix Truck Washout Water to Truck

Many ready mix concrete trucks 32 carry their own washout water. If, for example, the concrete truck washout water is used to wash out the concrete chute 33 into the washout tub 1, the additional water could exceed the capacity of the water holding tank 2.

In this case the strainer 3 and strainer hose 4 can be connected to the facility pump inlet 17 and the pump outlet 18 can connect to a hose 210 with a hooked pipe 220 on its end. The hook can be draped over a ready mix truck inlet hopper 215. In this manner, as the truck chute 33 washout proceeds, the washout water can be pumped by the facility pump 7 into the truck inlet hopper 215 for later disposal. The hooked pipe 220 can be positioned in the hopper 215 with an extended pole, by a rigid portion in the hose 210, or by a person climbing up to the hopper 215.

In another embodiment, water in the facility holding tank 2 can be pumped into a ready mix concrete truck 32 for disposal by connecting the facility pump inlet 17 to the water tank 2. Further, the hooked pipe 220 can be used to pump excess water to other receptacles possibly present at a job site or elsewhere.

4. Strainer Operation

Figure 4:
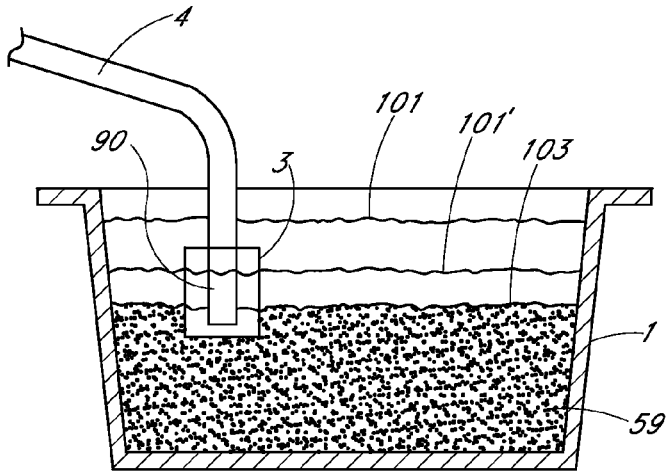
FIG. 4 illustrates an embodiment use of a strainer in conjunction with a portable concrete washout facility.

As best shown in FIG. 4 (and described in U.S. application Ser. No. 11/743,012 which is incorporated by reference), the strainer 3 is placed so it is partially submersed into the waste concrete or sediment 59. The sediment 59 will quickly settle to a level 103 below a water level 101. The strainer 3 allows removal of the water without picking up aggregate of sediment or other particles that could cause damage to the pump 7. In the embodiment shown, the portion of the strainer 3 immersed into the waste concrete or sediment will prevent ingestion of large objects such as aggregate. In the event that the strainer 3 clogs, the pump 7 can be stopped and the strainer 3 removed for cleaning.

As depicted, the strainer 3 can also comprise an extender pipe 90 extending below sediment level 103. If the extender pipe 90 was not used, and the strainer 3 was completely submersed beneath the initial water level 101, then water should pass easily. However, if the water level drops to a later water level 101', below the top of the strainer 3, the lack of an extender pipe 90 would allow air to be ingested into the hose 4, pump suction would be broken, and pumping would stop. Extender pipe 90 prevents air ingestion by moving the inlet to hose 4 below water level 102 as water is pumped, preventing air entry. Thus, positioning the strainer 3 such that its top is above the sediment level 103 but the extender pipe 90 extends below the sediment level 103 can ensure that air is not ingested into the hose 4 prior to removal of all water above the sediment level.

5. Water Recycling

At the end of the job, or when the water holding tank is nearly empty, the washout facility 100 can pump the waste water from the washout tub 1 into the water holding tank 2. With the exception of fibers used in some applications, the waste concrete and sediment naturally settle to the bottom of the tub 1, with relatively clean water above. The inlet valve 16 can be set to connect the strainer hose 4 to the inlet of the water pump 17 and the outlet valve 25 can be set to connect the outlet of the pump 18 to the water inlet 8. The strainer 3 can be placed into the washout tub 1 partially into the concrete and sediment at the bottom. Special designs of the strainer 3 can prevent the sediment from flowing into the strainer, while the clean water above is passed through and is pumped into the water holding tank 2. Fresh water can be added as necessary to make up for evaporation. The washout facility 100 can thus continue the job by reusing the waste water, or go to a new job, or go back to a disposal site for cleanout of the waste concrete and sediment. If fiber has been used in the concrete mix a removable screen 19 can be used to block the fibers from a section of the tub 1 so that the strainer 3 does not clog.

6. Emptying the Tub of Waste Concrete

After water removal and when the waste concrete 37 hardens and is ready for disposal, the washout tub 1 can be tipped over (e.g. from position 2A to position 2B as depicted in FIG. 5) using pivot 28 and releasing the waste concrete. A latch 29 restraining the tub 1 can be released prior to tilting of the tub. A partitioner 26 can be placed inside the facility washout tub 1 so that when the tub 1 is tipped over the waste concrete 37 breaks into pieces small enough to be easily disposed of either on the job site or at a remote disposal site, as depicted in FIG. 8. Similar actions can be performed on additional washout tubs such as the auxiliary tub 35.

7. Cleaning the Washout Facility

In some embodiments of the invention, the water holding tank 2 can be cleaned of sediment that accumulates in the tapered portion of the bottom, or other contaminants. To clean the tank 2 the bottom drain cap 22 on large diameter drain pipe 6 can be removed allowing the contents of the tank 2 to flow out. The large covered opening 21 on top of the water holding tank 2 can receive a hose to flush out the tank through the drain pipe 6 if desired.

For cleanout of the washout tub 1 after removing larger pieces of waste concrete, a large diameter cleanout drain 14 can be provided at that rear of the washout tub 1 along with a cover. Upon removal of the cover, the washout tub 1 can be washed clean with waste exiting through the cleanout drain 14. Alternatively, for embodiments including a pivot 28 for the washout tub 1, the washout tub 1 can be cleaned while in a tilted dumping position, such that waste can be easily dumped from the tub.

Further, the washout facility 100 can comprise jacks 13, 20 that can be adjusted to tilt the washout tub 1 toward the rear, also facilitating washout through the cleanout drain 14. Similarly, this can facilitate washout of the water holding tank 2.

Although the foregoing systems and methods have been described in terms of certain preferred embodiments, other embodiments will be apparent to those of ordinary skill in the art from the disclosure herein. Additionally, other combinations, omissions, substitutions and modifications will be apparent to the skilled artisan in view of the disclosure herein. While certain embodiments of the inventions have been described, these embodiments have been presented by way of example only, and are not intended to limit the scope of the inventions. Indeed, the novel methods and systems described herein may be embodied in a variety of other forms without departing from the spirit thereof. Accordingly, other combinations, omissions, substitutions and modifications will be apparent to the skilled artisan in view of the disclosure herein.

What is claimed is:

1. A portable concrete washout facility comprising:

a transport vehicle;

a water holding tank mounted on the transport vehicle and comprising a water inlet and a water outlet;

a pump connected to the water holding tank and in optional fluid communication with the water inlet via a first selector valve and the water outlet via a second selector valve;

a first hose connected at a first end to the first valve such that either the first hose or the water inlet is in fluid communication with the pump, and connected at a second end to a water-concrete separator; and a second hose connected at a first end to the second valve such that either the second hose or the water outlet is in fluid communication with the pump, and at a second end is configured to spray water at velocities sufficient to remove concrete.

2. The washout facility of claim 1, wherein the second end of the second hose comprises an extended hose portion and a hooked tube at its end configured to convey water into an inlet hopper of a concrete truck.

3. A portable washout facility for reducing washout water use and facilitating removal of waste comprising:

a transport vehicle;

a water holding tank mounted to the transport vehicle;

a means for conveying water, in fluid communication with the water holding tank;

a first hose connected to the water conveying means with a water-solid separator attached at an opposite end;

a second hose connected to the water conveying means; and a washout tub mounted on the transport vehicle and positioned to receive the water-solid separator and to receive water from the second hose, wherein the water conveying means is configured to actively pump water across the first hose into the water holding tank and across the second hose out of the water holding tank.

4. The washout facility of claim 3, wherein the water conveying means comprises only one pump.

5. The washout facility of claim 3, wherein the water conveying means comprises two or more pumps.

6. The washout facility of claim 3, wherein the water conveying means can pump water through both hoses simultaneously.

7. The washout facility of claim 3, wherein the water conveying means comprises two or more valves.

8. The washout facility of claim 3, wherein the washout tub comprises a screen separating a filament-free region from the remainder of the washout tub.

9. The washout facility of claim 3, wherein the washout tub can pivot so as to dump its contents.

10. The washout facility of claim 3, wherein the washout tub comprises material that releases easily from concrete.

11. The washout facility of claim 3, wherein the washout tub tapers such that an opening of the tub has a greater cross-sectional area than the base.

12. The washout facility of claim 3, wherein the second hose comprises a length sufficient to reach an inlet hopper of a concrete truck and further comprises a hooked tube at its end configured to deposit water into the inlet hopper.

13. The washout facility of claim 3, wherein the washout tub comprises partitioners configured to facilitate the breaking of hardened concrete removed from the tub.

* * * * *